United States Patent [19]

Ahlström

[11] 4,394,932

[45] Jul. 26, 1983

[54] VENDING MACHINE HAVING TILTABLE FLAP CLOSURE

[76] Inventor: Allan Ahlström, Mahults Herrgard, Simlångsdalen, Sweden, 31038

[21] Appl. No.: 292,429

[22] Filed: Aug. 14, 1981

[51] Int. Cl.[3] ..... G07F 11/52

[52] U.S. Cl. ..... 221/83; 221/91

[58] Field of Search ..... 221/84, 82, 83, 89, 221/91, 125, 126, 129; 194/10, 2

[56] References Cited

U.S. PATENT DOCUMENTS 1,065,029 6/1913 Craig et al. .
1,397,615 11/1921 Bassett .
2,408,444 10/1946 Payne .
4,087,020 5/1978 Krakauer .

FOREIGN PATENT DOCUMENTS 147172 6/1902 Fed. Rep. of Germany .
697279 9/1940 Fed. Rep. of Germany .

*Primary Examiner*—Stanley H. Tollberg
*Attorney, Agent, or Firm*—Cantor and Lessler

[57] ABSTRACT

A vending machine, preferably for cooled articles, comprises a number of drums subdivided into compartments and arranged as a stack within a cabinet to be individually rotatable about a horizontal shaft. A front and a rear shield covers the lower half of the stack and leave between themselves a passage. A flap, which is swingable about a horizontal shaft, reaches, in one of its positions, to the lower edge of the front shield and partly closes the passage. The machine comprises a selector mechanism, by which the position of an actuator can be adjusted to a desired drum and, when released, rotates the latter one step, and also tilts the flap, so an adjacent article can slide down a chute. The machine is provided with suitable release structure, for instance a coin-freed device, which by way of impulses to an electric motor causes a swinging movement of an arm in the actuator.

4 Claims, 8 Drawing Figures

FIG. 7
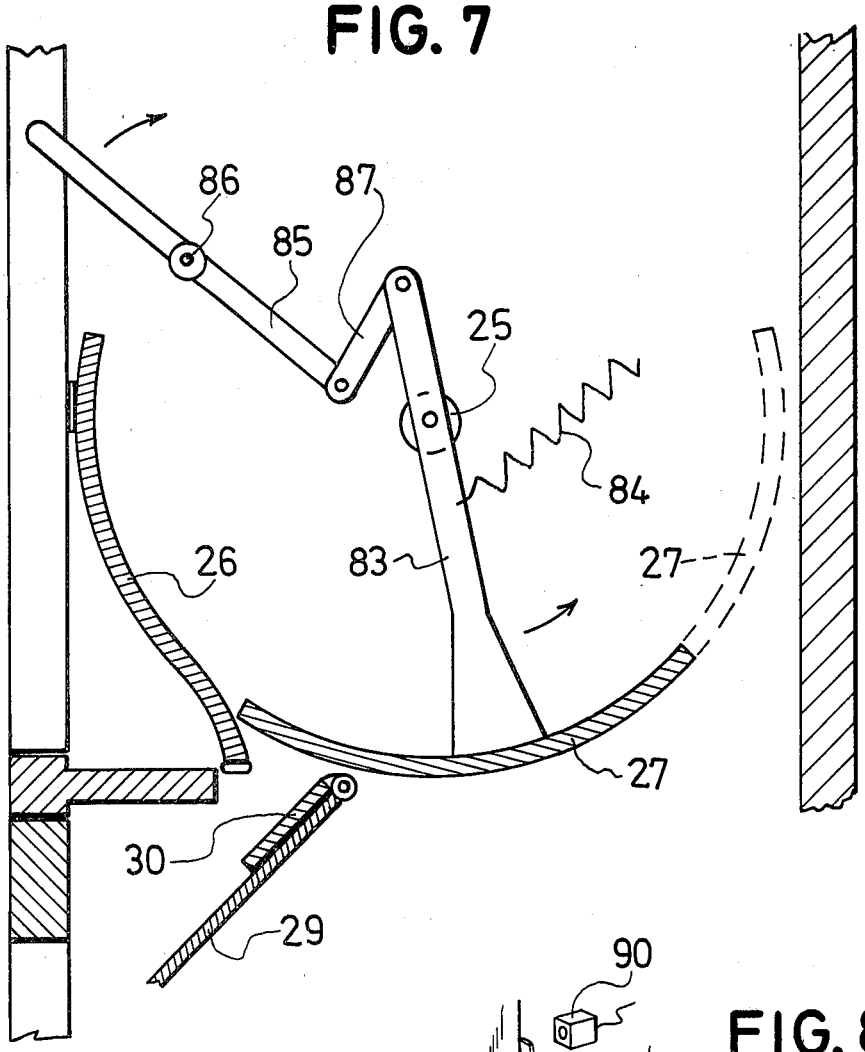
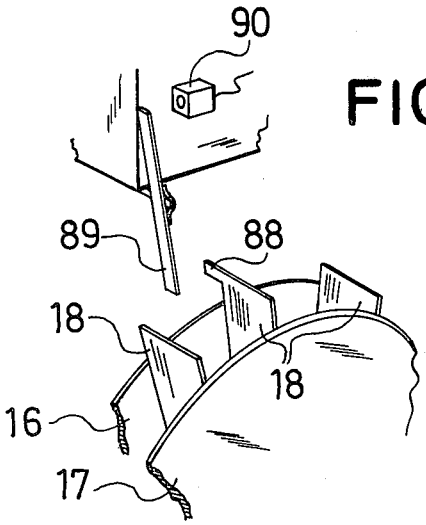
FIG. 8

VENDING MACHINE HAVING TILTABLE FLAP CLOSURE

BACKGROUND OF THE INVENTION

A general condition for vending machines is a compact design, which can hold a large number of articles—of unitary or varying form—while maintaining a simple selection and a release of an article only after full payment. Further problems will arise when the articles offered must be kept at a low temperature, when the risk of blocking by ice will occur.

A known type of vending machines comprises a number of generally circular drums, subdivided into radial compartments, and arranged into a stack, in which the drums are individually rotatable upon a horizontal shaft. The lower half of the stack of drums is covered by a shield preventing an unintentional dropping-out of articles from downwardly turned compartments.

SUMMARY OF THE INVENTION

The present invention refers to vending machines of last mentioned type and is especially suited for dispensing frosen goods, such as ice-cream of packages of foodstuff, but which may be used for other pieces of goods made up into packages of handy size, which must not necessarily be cooled.

A vending machine according to the invention is characterized in that the shield comprises a front and a rear portion, which each extends over an arc less than 90°, and of which the rear portion is displaceable and, in use, leaves a passage between its front edge and the lower edge of the front portion, and in that a flap pivotable about a horizontal axis is adapted, in one position partly to close said passage, an actuator operable by the release mechanism being adapted to rotate a selected drum and to tilt the flap from its closing position.

Each drum may comprise two end discs and radial partitions there-between, the partitions preferably having a bigger radial extension than the end discs. The ends of the partitions projecting outside the discs are preferably adapted for cooperation with a member in the actuator.

Braking means including blocks are preferably mounted upon swingable arms and located above the stack of drums, one block being provided at each drum for cooperation with the compartments thereof and permitting a stepwise rotation thereof.

A mechanism for moving the rear shield portion may comprise an arm, which, when the passage is closed by the rear shield projects through the opening through which the drums are accessible.

BRIEF DESCRIPTION OF THE DRAWING

FIG. 7 shows a mechanism for swinging the rear shield to a position used when filling the drums, and FIG. 8 shows a detail view of a vending machine having signal means indicating when a drum is empty.

DESCRIPTION OF SOME PREFERRED EMBODIMENTS

Figure 1:
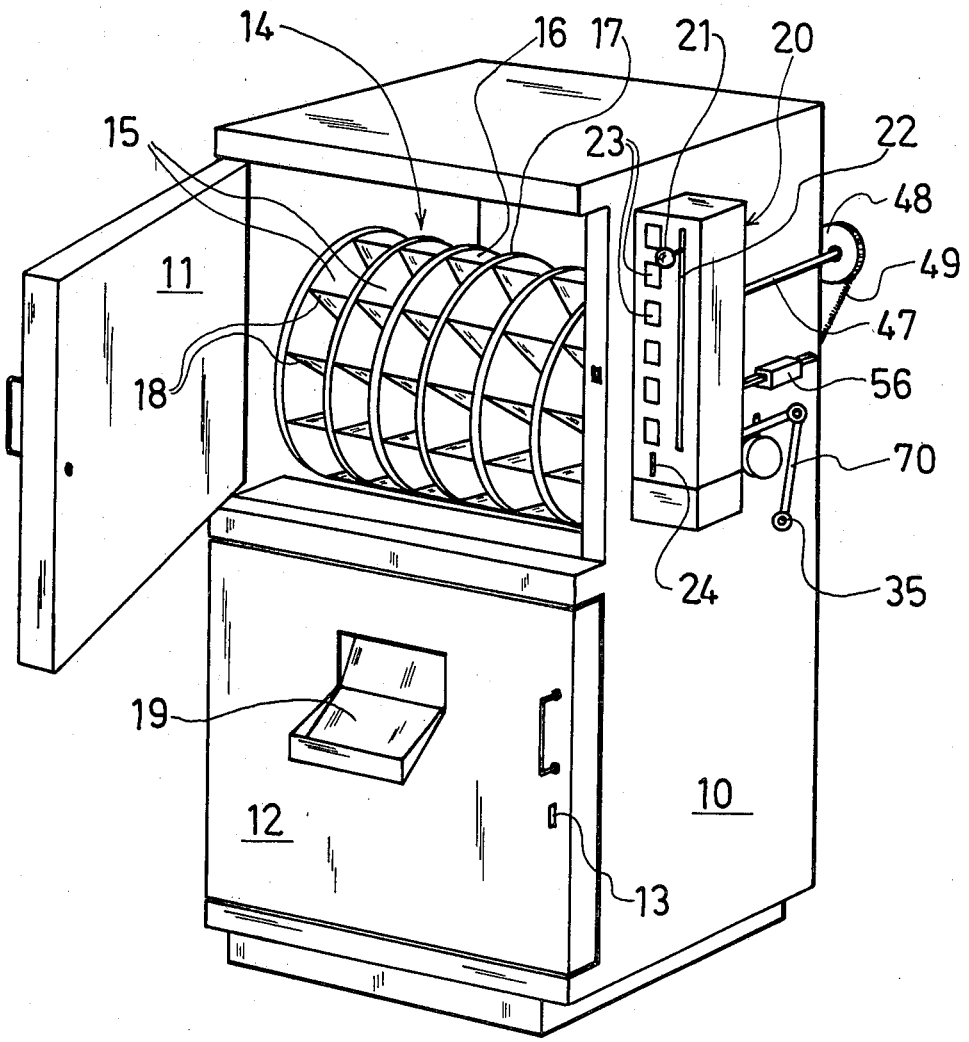
FIG. 1 shows a vending machine with an open door.

FIG. 1 shows a vending machine built into a cabinet 10, the interior of which is accessible through two doors 11 and 12. Both doors are provided with locks 13 to be individually lockable. In an upper compartment, accessible through door 11, there is a stack 14 of flat drums 15, which are individually rotatable upon a horizontal shaft 25.

Each drum 15 comprises two end discs 16, 17, and a number of radial partitions 18 therebetween. The shape of the components of the drum will be explained below. In the upper compartment there are further braking and signal means, not shown in FIG. 1.

In a lower compartment, accessible through door 12, an actuator and a refrigerating machinery are mounted, and will also be explained later on. In the door 12 there is a discharge opening 19. At the outside of the cabinet there is a release and selector mechanism 20, and components operated thereby, the function of which will be explained in connection with FIG. 6.

In relation to FIG. 1 it will be sufficient to explain that a handle 21 may be moved up or down in a slot 22 to positions mating with labels 23, telling about the contents in the various drums. The labels may possibly be transparent and be lighted from behind. A coin insert slot it denoted by 24.

Figure 2:
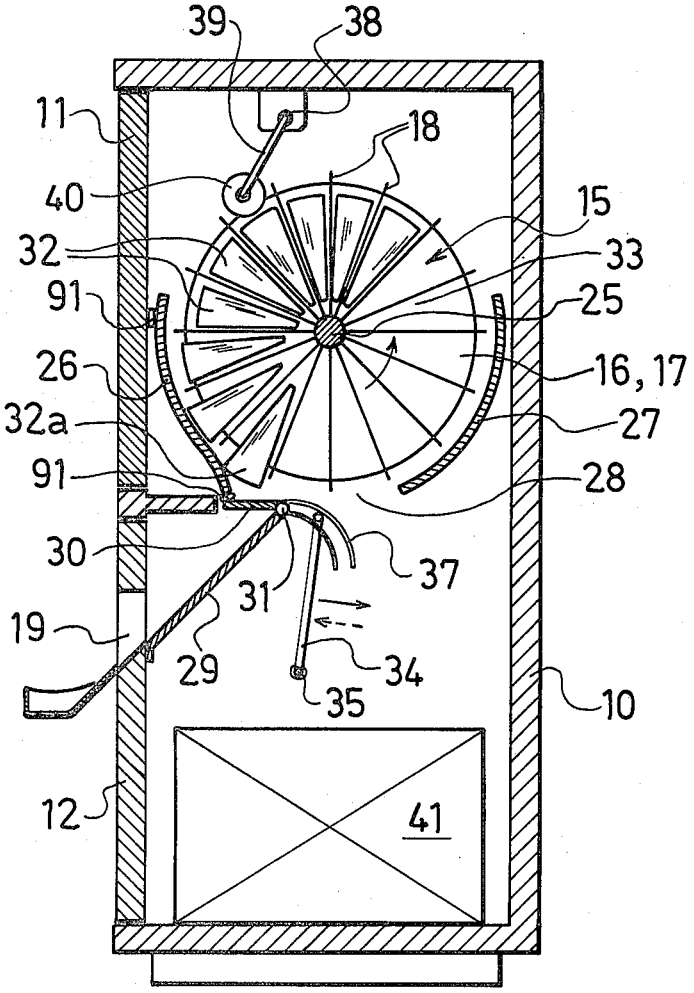
FIG. 2 shows a vertical section through the machine.

The interior of the cabinet will be evident from FIG. 2. The drums are rotatable about the horizontal shaft 25, and the partitions 18 have a bigger radial extension than the end discs 16, 17. A front shield 26 is fixedly mounted in the upper compartment, covering part of the lower half of the stack 14 of drums.

A rear shield 27 covers, in a corresponding manner, a further portion of the stack 14, but is swingable about shaft 25, in the manner shown in FIG. 7. Each of the two shields cover less than 90° of the circumference, and in use there will be a passage 28 between the lower edges of the two shields 26 and 27.

An inclined wall 29 extends downwardly from the space between the shields, and forms a chute to an opening 19 in the lower door 12. At the upper end of the wall a flap 30 is mounted, and is pivotable about a horizontal shaft 31. It is normally retained in a horizontal position, reaching about to the lower edge of the front shield.

The front shield 26 supports the articles 32 located in the juxtaposed drum compartments 33 between the partitions 18. It is presupposed that the drums are rotated anti-clockwise (in FIG. 2). Compartments located to the right of the upper edge of the inclined wall 29 have been emptied.

In the lower compartment of the cabinet there is an actuator—which will be explained in connection with FIGS. 4 and 5—and which includes a crank-shaped lever 34, which is swingable about a shaft 35.

The lever 34 actuates a swinging arm 36, which at its upper end has an articulated finger **36*a*. This is rigid when the lever swings clockwise, and is so long that it will reach into the interspaces between the partitions 18, and can rotate a selected drum one step. The extent of the swinging movement of arm 36 is selected so the drum is moved through an angle corresponding to one compartment 33. When the lever 34 is returned (anti-clockwise) the finger 36*a*** is folded and does not actuate any drum.

The flap 30 is provided with an inwardly directed, arcuate arm 37, which grips the lever 34, so the flap will be tilted downwardly, from its horizontal position, when the lever is swung. An object 32a which has rested upon the front shield adjacent to the flap can then slide down along the inclined wall 29, and out through the opening 19, while the selected drum is rotated one step. When the lever 34 is brought back it returns the flap 30 to its horizontal position.

In the upper compartment of the cabinet there is a brake means, which for each drum comprises an arm 39, which is swingable about a trunnion 38 and carries a cylindrical block 40. When the associated drum is rotated the block will be lifted over the partition 18 behind it, whereupon the block falls down in the following compartment and thus only permits a stepwise rotation of the drum.

In the lower compartment of the cabinet a refrigerating machinery 41 of conventional type is mounted for maintaining the air within the cabinet at a desired temperature. Thermostats and other governing devices are known in the art and need not be shown. The cooled air will circulate through the open portion of the passage 28, and the drums 15 are spaced apart sufficient to permit air to pass between them for a full cooling.

The walls and the doors of the cabinet, as well as the shields 26 and 27, the inclined wall 29 and the flap 30 are insulated. It should be noted that the forward shield 26 and the flap 30 will form a heat insulated lock between the inner, cooled compartment and the discharge opening 19, which is open to the ambient air. During a discharge only a very short communication between the space inside of opening 19 and the interior of the cabinet will occur, so the risk of heat loss and condensation is small.

The cabinet contains a number of drums 15, in the embodiment shown there are six drums, and in the first hand the proper drum must be selected, depending upon the goods contained therein.

Figure 3:
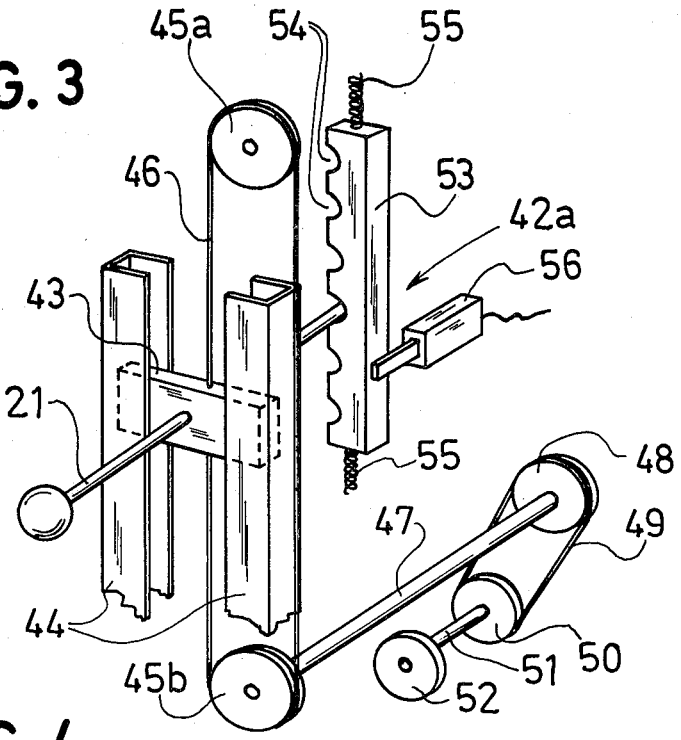
FIG. 3 shows schematically a portion of the selector mechanism.
Figure 4:
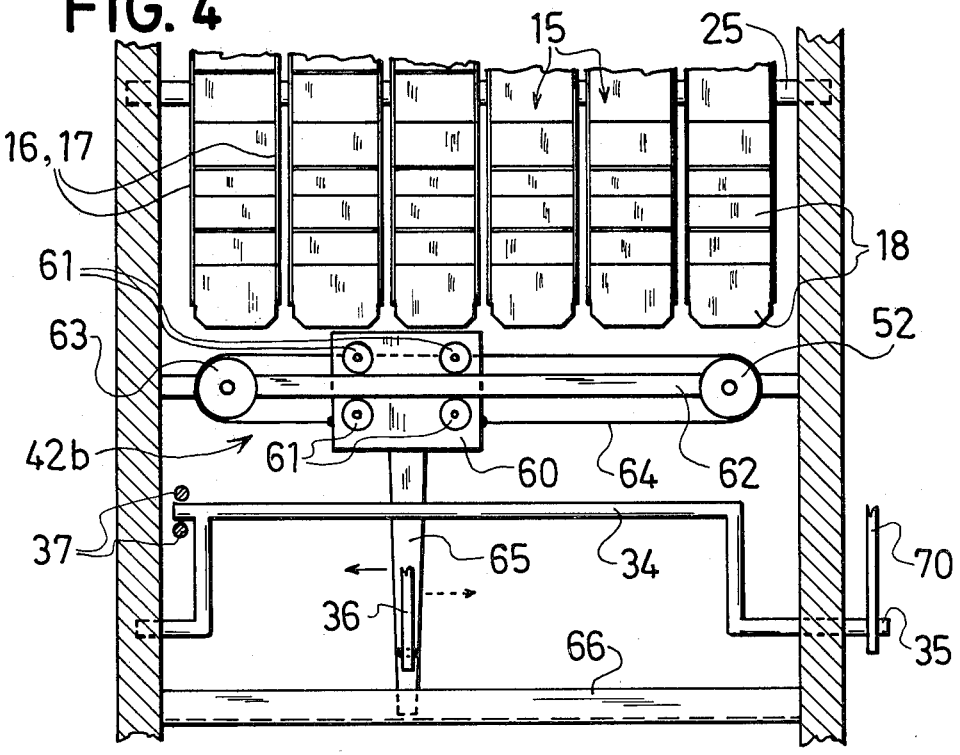
FIG. 4 shows other parts of the selector mechanism.

The selector mechanism comprises an outer part 42a, shown in FIG. 3, and an inner part 42b, shown in FIG. 4.

The outer part 42a is operated by means of the lever 21 (shown in FIG. 1) and is displaceable vertically to bring along a sliding member 43, running between two guides 44. Two sprocket wheels 45a, 45b, are mounted at the cabinet, and a chain 46 is attached to the sliding member 44, and is led over the wheels 45a, 45b. The latter is mounted upon a shaft 47, which at its other end carried a sprocket wheel 48.

This drives a chain 49 and a further sprocket wheel 50 mounted upon a shaft 51. This carries a further sprocket wheel 52, which is included in the inner part 42b of the selector mechanism (see FIG. 4). It is evident that a displacement up or down of the lever 21 will rotate wheel 45b, and finally also wheel 52 in the inner part 42b of the selector mechanism.

The lever 21 cooperates with a ratchet bar 53 having notches 54 along one of its sides. These notches are arranged so they will position the selector mechanism in relation to the various drums and are located level with the labels 23.

The ratchet bar 53 is displaceable sidewards, which is indicated by the spring suspension means 55. The bar will thus be displaced outwardly when the lever 21 is brought upwards or downwards between the notches 54. A magnetic catch 56 is, in the manner to be described in connection with FIG. 6, adapted to lock the bar 53 during a discharge operation, so the lever 21 cannot be moved.

Further catches (not shown) of known design are provided to prevent operation if the lever 21 has not been brought fully into any notch 54, so the bar 53 remains in an outwardly displaced position.

The inner part 42b of the selector mechanism comprises (see FIG. 4) a sliding member 60, which is carried by four wheels 61 upon a horizontal bar 62, to be displaceable along the same. The previously mentioned sprocket wheel 52 is mounted at one end of bar 62, and at the opposite end thereof is a further sprocket wheel 63.

A chain 64 is led over wheels 52 and 63, its ends being attached to opposite sides of the sliding member 60. An arm 65 projects downwardly from the sliding member and is, at its lower end, guided in a channel member 66.

The previously mentioned arm 36 is pivotably attached to the lower end of arm 65, and cooperates with the crank-shaped lever 34, so it can be swung towards and away from the rear wall of the cabinet. Its finger 36a will cooperate with the projecting parts of the partitions 18, as described above, in order to rotate a selected drum 15.

The lever 37 at flap 30 is fork-shaped, and is in the left hand part of FIG. 4 shown as gripping an extension of the bow lever 34. In FIG. 4 only the lower part of arm 36 is shown for the sake of clarity.

Figure 5:
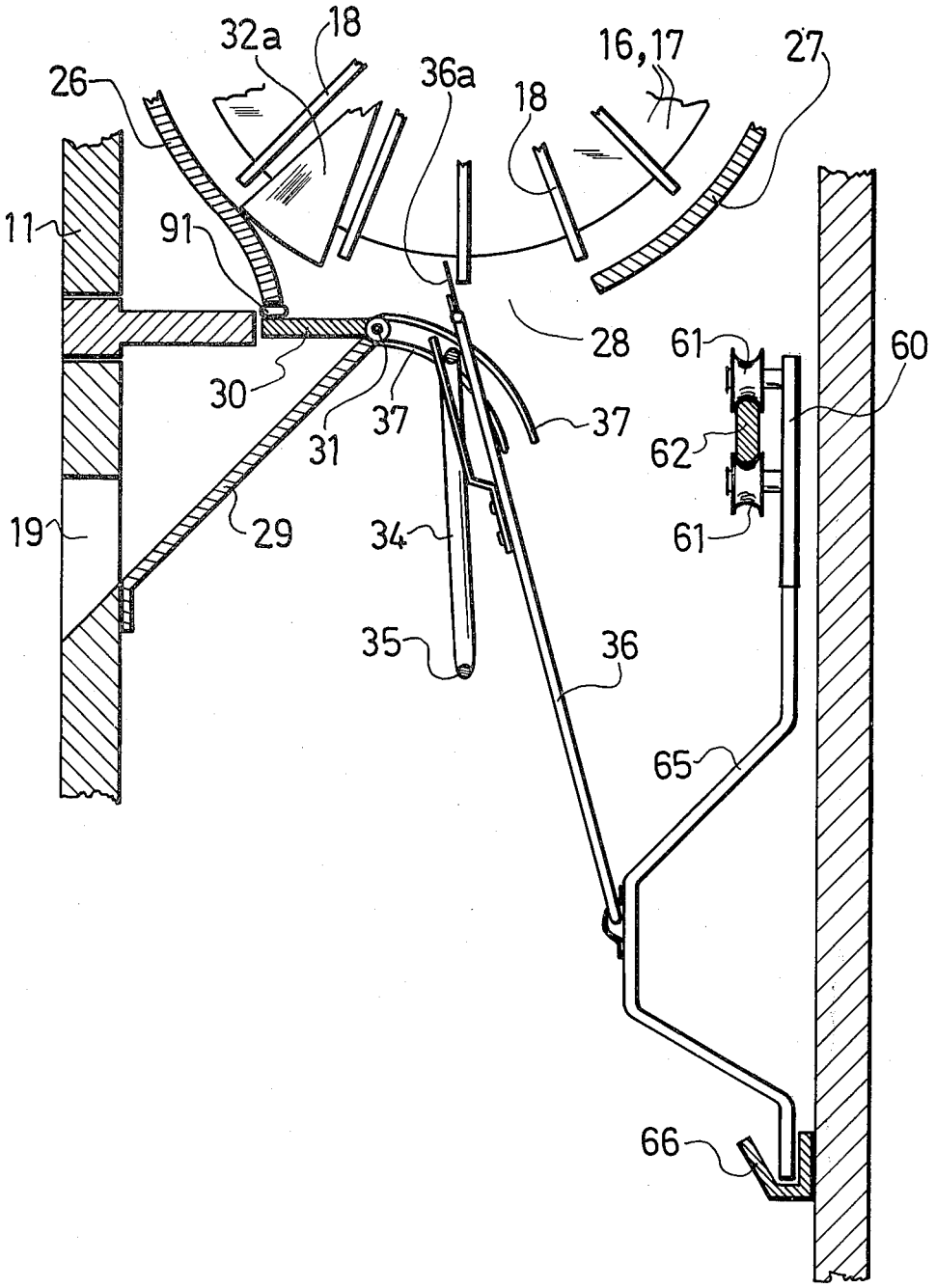
FIG. 5 is a detail view showing the cooperation between the selector mechanism, an actuator and a drum.

FIG. 5 shows the cooperating parts of the selector and actuator mechanisms in a cross section through the cabinet. Shaft 35 of the bow lever 34 extends—as is evident from FIG. 4—through one side wall of the cabinet and is operable by a lever 70, which is also shown in FIG. 1.

Figure 6:
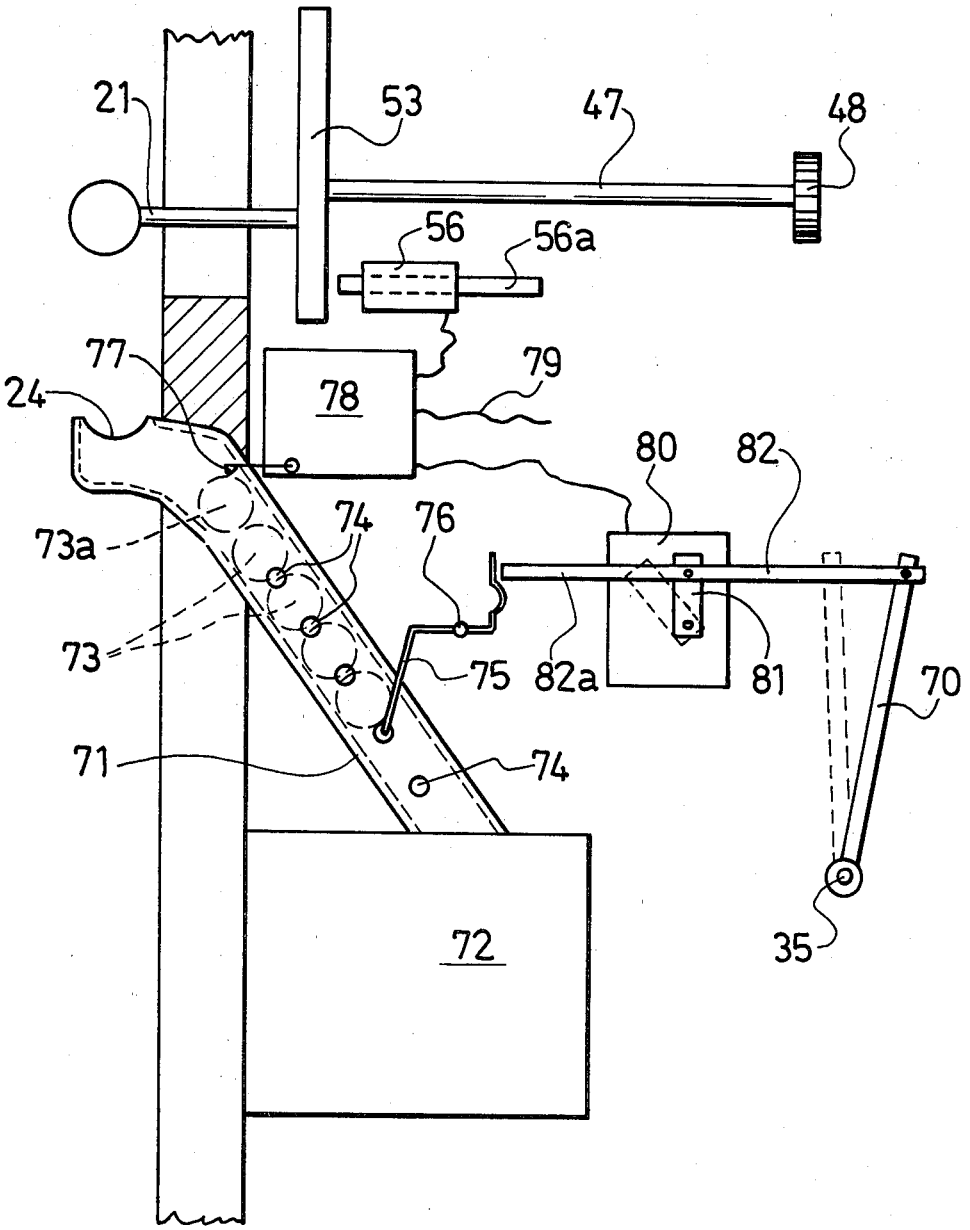
FIG. 6 shows the coin release mechanism and components actuated thereby.

For controlling a discharge from the vending machine a release mechanism of arbitrary known type may be used, for instance a coin-freed mechanism of the kind shown in FIG. 6. It is however evident that other mechanisms, operated by tookens, upon which the discharges are stamped, or including a counter connected to a central control means may be used.

In the embodiments shown in FIG. 6 a chute 71 extends obliquely downwards from the coil slot 24, to a collecting box 72. The chute 71 is adapted to receive coins of a certain sze, and is in one of its side walls provided with a row of openings 74 spaced apart by a distance corresponding to the diameter of the coins.

An adjustable catch member 75, which is swingable about a trunnion 76, may be brought to cooperate with a selected opening 74, to temporarily block the passage for a given member of coins. When a required number of coins have been fed into the chute the uppermost coin 73a will actuate a switch 77, which will close a circuit and start the actuator—if there is no fault signal from some source, for instance from the ratchet bar 53, as described above.

A control unit 78 is connected to a current supplying catch 79, and to other control and catching devices (not shown) and issues, upon the receipt of a signal from switch 77 a current pulse to an electric motor 80. This pulse of current is sufficient to turn a crank 81 attached to the motor one quarter of a revolution (anti-clockwise).

The crank 81 is, by way of a rod 82, connected to lever 70, and swings the latter through the necessary angle to make crank-lever 34 perform its required movement. An extension 82a of the rod will during this movement push against the coin catching member 75, so it releases the coins which fall down into the box 72.

The control unit 78 will also issue a current pulse to the magnetic catch, above referred to, the armature 56*a* of which is pushed outwards and locks the ratchet bar 53.

The coin catching member 75 may be spring loaded, so it is automatically brought back into its catching position, and the crank 81 and the armature 56*a* of the magnetic catch can be returned by means of counter-directed current pulses. A contactor (not shown) is located in a suitable position to issue a signal to the control unit 78 when the crank lever 34 and the flap 30 have performed their releasing movements.

As mentioned above the front shield 26 and the flap 30 will support the objects located in compartments 33 at the lower, link half of the drums, while the remainder of passage 28 is open behind the flap 30.

In order to make possible a re-filling of the drums, without objects falling down into the space below, the rear shield 27 is swingably mounted. It is carried by arms 83, which are journalled upon the drum shaft 25, at least one of them extending a distance beyond the latter. They are biased by a spring 84, which tends to bring the rear shield back to its normal position for use. FIG. 7 shows in full lines how the rear shield 27 abuts against the front shield 26, so the passage 28 will be fully closed. The normal position of the rear shield is indicated in brooken lines.

The rear shield is operated by means of a lever 85, which swings about a trunnion 86, and by way of a link 87 is connected with the extension of one of the arms 83. The lever 85 has such a length that it, when the rear shield has been swung to its passage closing position, will project through the door opening, preventing a closing of the door until the shield has been returned to its normal position. With a proper balancing of the biasing force of spring 84 a closing of the door may force the shield to its desired position.

FIG. 8 shows an arrangement for indicating when a certain drum has been emptied. A projecting portion of one of the partitions 18 is provided with a sidewardly extending peg 88. When filling the drum care should be taken that this particular partition is located at the beginning of the path of movement. When the drum has rotated a full turn, peg 88 will contact a rocker 89 which pushes against a switch 90. This issues a signal to some suitable indicating device which shows that this particular drum is empty. Such signal may for instance means that the lamp behind the associated label 23 is switched off.

For practical reasons the rockers are preferably mounted together with the braking devices 39, 40, above the drums, which means that the compartment where the peg 88 is fitted, is not the last one to hold some goods, but is located at a certain angular distance from the latter.

The embodiments above described and shown in the drawings are examples only of the invention, the details of which may be varied in many ways within the scope of the appended claims.

The selector and governing systems may be designed and augmented in various ways. The switch 77 can thus be made to light a signal lamp telling that the machine is operable, whereupon a pressure upon a push-button will start the feeding out operation. In refrigerated cabinets sealings 91 are preferably provided between movable and stationary components, for example between the front shield 26 and door 11 as well as flap 30. The partitions 18 need not extend beyond the end discs, as the finger 36*a* may be arranged to contact projections upon one of the end discs of each drum.

What I claim is:

1. A vending machine of the type where a number of drums are arranged in a cabinet to be rotatable about a horizontal shaft and which includes a mechanism for selecting either of the drums and a release mechanism permitting rotation of a selected drum, the machine further comprising a front shield and a rear shield each covering less than 90° of the lower circumference of said drums, said front shield being stationary while said rear shield is swingable about the shaft carrying said drum between a first position in which it leaves a passage between itself and said front shield and a second position in which it closes said passage a flap tiltable about a horizontal axis to occupy either of two positions and adapted in one of said positions to partly close said passage, and an actuator operable by said release mechanism for rotating a drum selected by said selector mechanism and to tilt said flap into the other of its said positions.

2. The vending machine according to claim 1, where each drum comprises two end discs and radial partitions therebetween in which said partitions have a bigger radial extension than said end discs, the ends of said partitions projecting outside said discs being adapted for cooperation with a member in said actuator.

3. The vending machine according to claim 2, further including braking means comprising blocks mounted upon swingable arms and located above said drums, one block being provided at each of said drums for cooperation with compartments thereof formed between said partitions and permitting a stepwise rotation of the associated drum.

4. The vending machine according to claim 1, in which said cabinet has an opening for making said drums accessible for refilling and a door for closing said opening, and further including a mechanism for swinging said rear shield between said first and second positions, said swining mechanism including an arm, which when said mechanism has brought said rear shield to its second position projects through said door opening.

* * * * *